US006886643B2

(12) United States Patent
Riley et al.

(10) Patent No.: US 6,886,643 B2
(45) Date of Patent: May 3, 2005

(54) SHAFT LOCK MECHANISM FOR A ROTARY POWER HAND TOOL

(75) Inventors: Jonathan G. Riley, Chicago, IL (US); David Pozgay, Evanston, IL (US)

(73) Assignee: Credo Technology Corporation, Broadview, IL (US)

( * ) Notice: Subject to any disclaimer, the term of this patent is extended or adjusted under 35 U.S.C. 154(b) by 0 days.

(21) Appl. No.: 10/656,804

(22) Filed: Sep. 5, 2003

(65) Prior Publication Data

US 2005/0051348 A1 Mar. 10, 2005

(51) Int. Cl.[7] ..... E21C 7/02
(52) U.S. Cl. ..... 173/29; 173/217; 173/216; 173/171
(58) Field of Search ..... 173/29, 217, 216, 173/171

(56) References Cited

U.S. PATENT DOCUMENTS

| | | | | |
|---|---|---|---|---|
| 2,119,986 A | | 6/1938 | Dremel | |
| 3,872,951 A | | 3/1975 | Hastings, Jr. | |
| 4,197,886 A | * | 4/1980 | MacDonald | 81/442 |
| 4,491,445 A | * | 1/1985 | Hunger et al. | 409/234 |
| 4,823,885 A | * | 4/1989 | Okumura | 173/178 |
| 4,844,177 A | * | 7/1989 | Robinson et al. | 173/178 |
| 5,813,805 A | | 9/1998 | Kopras | |
| 5,842,527 A | * | 12/1998 | Arakawa et al. | 173/48 |
| 6,360,828 B1 | * | 3/2002 | Chung | 173/93.5 |
| 6,443,675 B1 | | 9/2002 | Kopras et al. | |
| 6,647,836 B1 | * | 11/2003 | Habermehl | 81/434 |
| 6,715,562 B1 | * | 4/2004 | Chen | 173/93.5 |
| 6,793,023 B2 | * | 9/2004 | Holzer et al. | 173/178 |

OTHER PUBLICATIONS

Hanke, Adjustable spindle lock, Oct. 18, 2001, US 2001/0030051 A1.*
Droste, Power Tool, Jul. 15, 2004, US 2004/0134673 A1.*

* cited by examiner

*Primary Examiner*—Scott A. Smith
*Assistant Examiner*—Brian Nash
(74) *Attorney, Agent, or Firm*—Greer, Burns & Crain, Ltd.

(57) ABSTRACT

A preferred embodiment comprises a power hand tool of the type which has a generally cylindrical elongated plastic housing with a motor contained within the housing and having an output shaft that extends from the front end portion of the hand tool, and which has a metal front end portion that cooperates with the plastic housing to strengthen a shaft locking mechanism located at the front end of the hand tool. The metal front end portion not only strengthens the outer surface of the housing in the front end portion of the tool, but also has a pair of internal structural ribs positioned to absorb stress that may be present in the housing as a result of force applied to the shaft locking mechanism. The preferred embodiment is also designed to enable the shaft locking pin mechanism to be easily assembled and retained without the need for an E-clip or C-clip as is commonly the practice in commercially available spiral saw hand tools.

15 Claims, 5 Drawing Sheets

SHAFT LOCK MECHANISM FOR A ROTARY POWER HAND TOOL

BACKGROUND OF THE INVENTION

The present invention generally relates to power rotary hand tools and more particularly to an improved shaft lock mechanism for the same.

Small rotary hand tools that have a generally cylindrical housing or case have been marketed for many years for use in carrying out various woodworking and metal working tasks by hobbyists as well as commercial artisans. Such rotary hand tools generally have a motor unit with a rotary output shaft extending from the nose end and often have a nose portion that is configured to connect to various accessories or attachments. Some of these rotary hand tools are somewhat larger and more powerful and are known in the building trade as spiral saws that use a side cutting bit to penetrate and to rapidly cut holes for electrical outlets, light fixtures and switches and the like in dry wall. Because these tools are quite powerful even though they are relatively small, they are convenient to use on a jobsite or just about anywhere else where a source of AC power is available.

Because such power hand tools can be used to perform many tasks, artisans in the building trades use them extensively and generally give them rough treatment during use. Because these tools are often the subject of abusive treatment, they must be ruggedly built to last. These tools typically have a chuck mounted on the motor output shaft for retaining side cutting spiral saw bits, drill bits, grinding tools and the like, so it is necessary to hold the output shaft from rotting so that the chuck can be tightened or loosened to change bits.

These tools therefore are provided with a convenient shaft locking mechanism that generally comprises a button in the front portion of the housing that has a spring loaded locking pin that can be inserted into an opening in the output shaft when it is correctly positioned and the button is depressed. One of the desirable features of such tools is that they are powerful but not particularly heavy. Their relatively light weight is at least in part due to the fact that the housing is fabricated from a strong, but lightweight plastic material.

It can be appreciated that when the locking pin is inserted into the output shaft and a user applies a lot of force to tighten or loosen the chuck, there can be substantial stress applied to the portion of the housing where the locking pin mechanism is located. Users are also known to depress the locking button after power has been turned off, but before the shaft stops rotating, for the purpose of applying a braking force to the shaft. Using the locking pin mechanism as a brake is not what the tool is designed for and can result in damage to the tool.

SUMMARY OF THE INVENTION

A preferred embodiment comprises a power hand tool of the type which has a generally cylindrical elongated plastic housing with a motor contained within the housing and having an output shaft that extends from the front end portion of the hand tool, and which has a metal front end portion that cooperates with the plastic housing to strengthen a shaft locking mechanism located at the front end of the hand tool. The metal front end portion not only strengthens the outer surface of the housing in the front end portion of the tool, but also has a pair of internal structural ribs positioned to absorb stress that may be present in the housing as a result of force applied to the shaft locking mechanism. The preferred embodiment is also designed to enable the shaft locking pin mechanism to be easily assembled and retained without the need for an E-clip or C-clip as is commonly the practice in commercially available spiral saw hand tools.

DESCRIPTION OF THE PREFERRED EMBODIMENT

Figure 1:
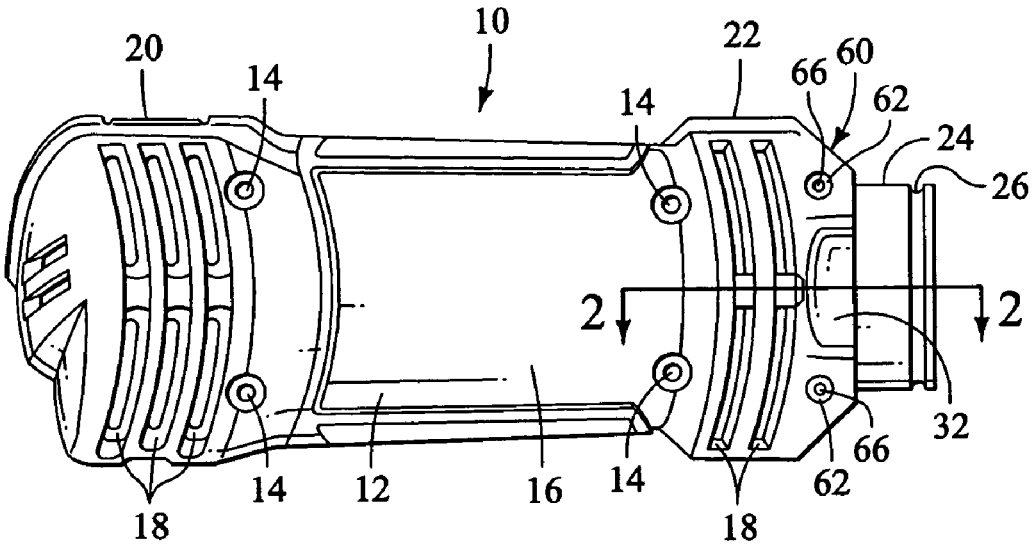
FIG. 1 is a side view of a preferred embodiment of the rotary power hand tool.

A preferred embodiment of the rotary power hand tool of the present invention is indicated generally at 10 in FIG. 1. It has a housing that is preferably comprised of an upper section 12 which is visible in FIG. 1 and a lower section that is not. The two sections are designed to mate with one another and are held together by four screws or star configured bolts 14 that engage a surface in the lower section. Both of the mating plastic sections and preferably made of a plastic or plastic like material which is relatively light weight but strong and impact resistant.

A motor (not shown) is located in a central portion 16 of the hand tool and ventilation openings 18 are located in a rear portion 20 as well as a front portion 22. A nose portion 24 is preferably located at the front end portion 22, which has a generally cylindrical shape and an annular recess 26 at the outer end thereof. The nose portion 24 is provided so that accessories or attachments can be mounted to the tool to assist or carry out the desired operations. For example, a depth guide accessory may be attached to the nose portion 24 when a spiral or side cutting bit is used with the tool, the depth guide limiting the depth of cut, which is desirable for cutting holes in drywall for example. A right angle attachment having a circular saw blade may also be mounted to the nose portion 24.

Figure 2:
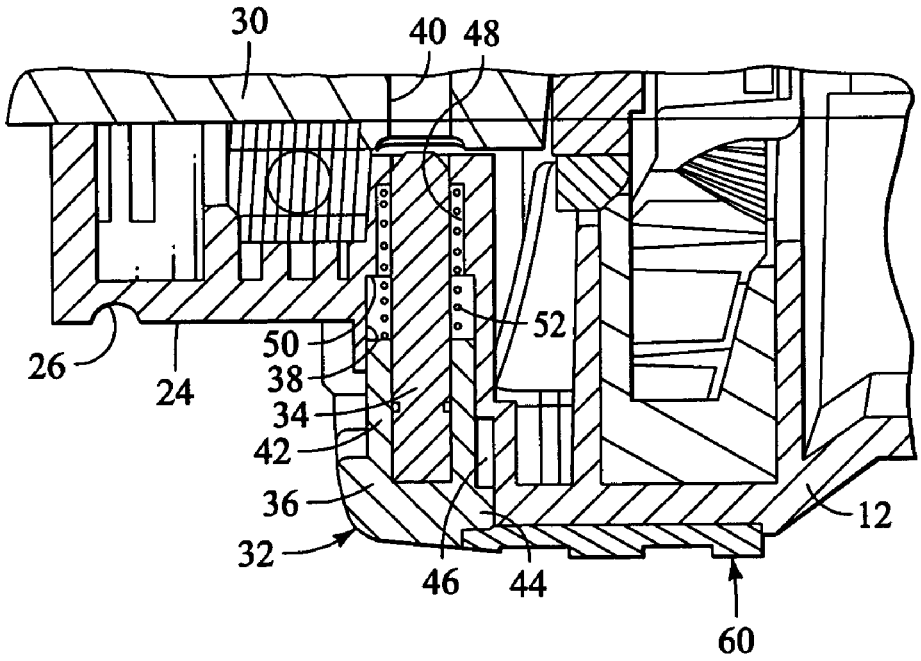
FIG. 2 is a cross-section taken generally along the line 2—2 of FIG. 1 and illustrating the shaft locking mechanism of the preferred embodiment.

As shown in FIG. 2, a motor output shaft 30 is driven by the motor and typically has a chuck (not shown) for retaining a drill bit, spiral saw bit or other tool. The preferred embodiment of the hand tool 10 has a locking pin member, indicated generally at 32, which preferably has a cylindrical pin 34 that is molded in a button 36 that fits within a channel 38 that is molded in the housing section 12. The button 32 can be pushed inwardly as shown in FIG. 2, i.e., toward the output shaft 30 which preferably has a hole 40 that may extend partially inwardly or completely through the shaft, with hole 40 being sized to receive the end of the pin 34 when the button 32 is depressed. This enables the user to hold the shaft from rotation while the chuck is either tightened or loosened to install or remove the shank of a tool bit from the chuck.

The button 36 is preferably molded around the cylindrical pin 34 and has a cylindrical portion 42 and a relatively wide outer surface that is suited to be depressed by a user. A small centered retaining flange 44 rides in a slot 46 (best shown in FIGS. 3 and 4). The channel 38 has a smaller diameter portion 48 with the interface between the portions 38 and 48 defining an annular flange 50 that limits the inward movement of the button 32. A spring 52 is provided for biasing the button outwardly away from the shaft 30.

A front end metal portion 60 is shown in FIGS. 1 through 5, which preferably comprises two sections, only one of which is shown in the drawings, the other being a complementary mating portion that is located on the opposite side of the section 60 which is shown in the drawings. The two sections are configured to fit together and be secured by screws 62 and also to matingly engage the plastic sections of the housing, only section 16 of which is shown in the drawings. The metal portion 60 is preferably molded from aluminum and cooperates with the structural configuration of the plastic section 16 so that it is in close contact with many of the plastic surfaces and thereby is in position to absorb stresses that are applied to the plastic section 16 during operation of the locking mechanism 32. In this regard, the plastic structure has air ventilating openings 18 (see FIG. 6) and the metal portion 60 has similar openings 63 that also have inwardly directed raised walls 64 that are configured to fit within the plastic openings 18 in close engagement.

Figure 3:
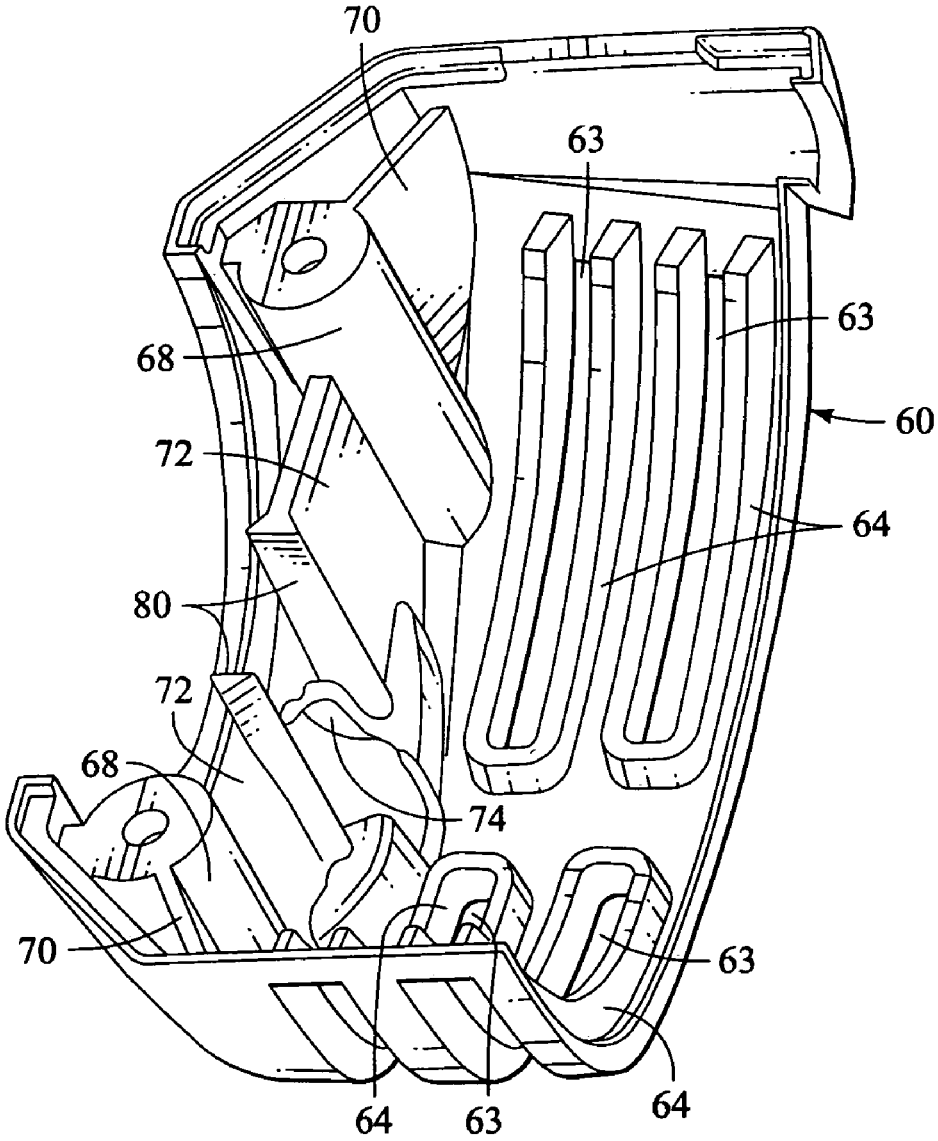
FIG. 3 is a perspective view of a portion of a front end metal portion of the preferred embodiment shown in FIG. 1.
Figure 4:
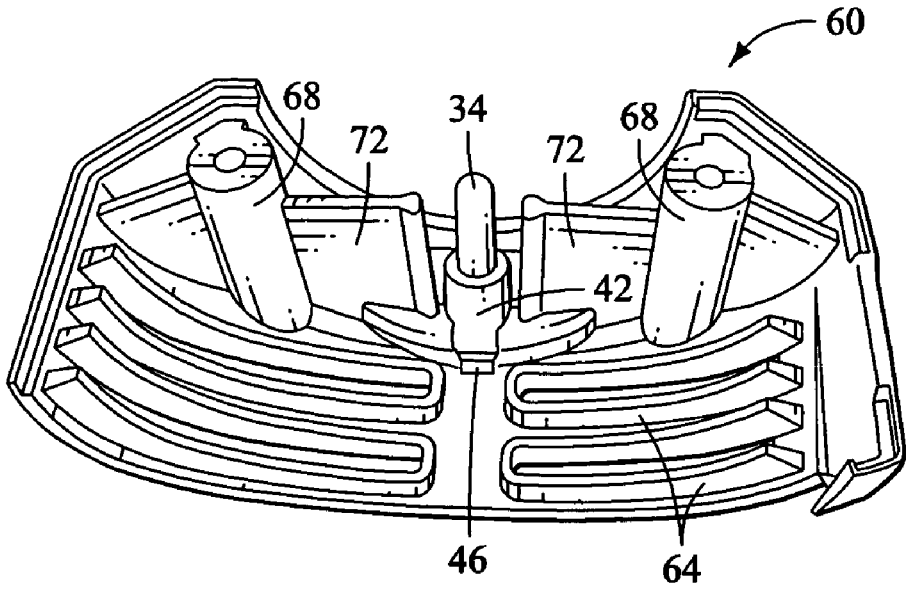
FIG. 4 is a perspective view of the front end metal portion shown in FIG. 3, but including the locking member used in the preferred embodiment.
Figure 5:
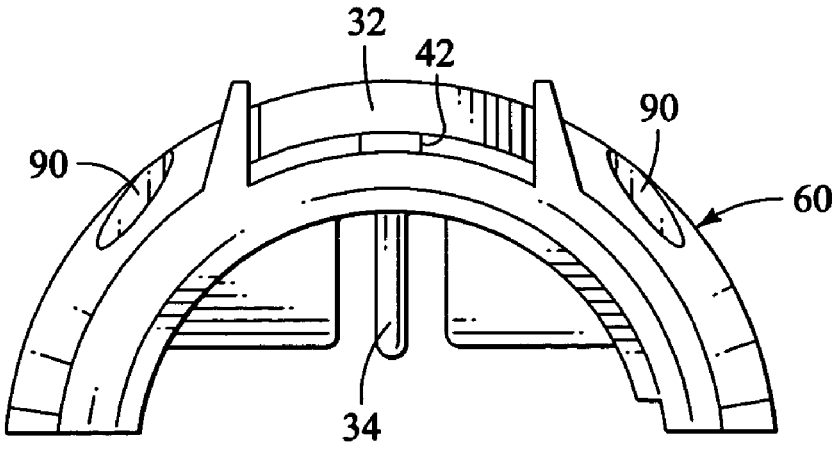
FIG. 5 is a top plan view of the front end metal portion shown in FIGS. 3 and 4 together with the locking member.
Figure 6:
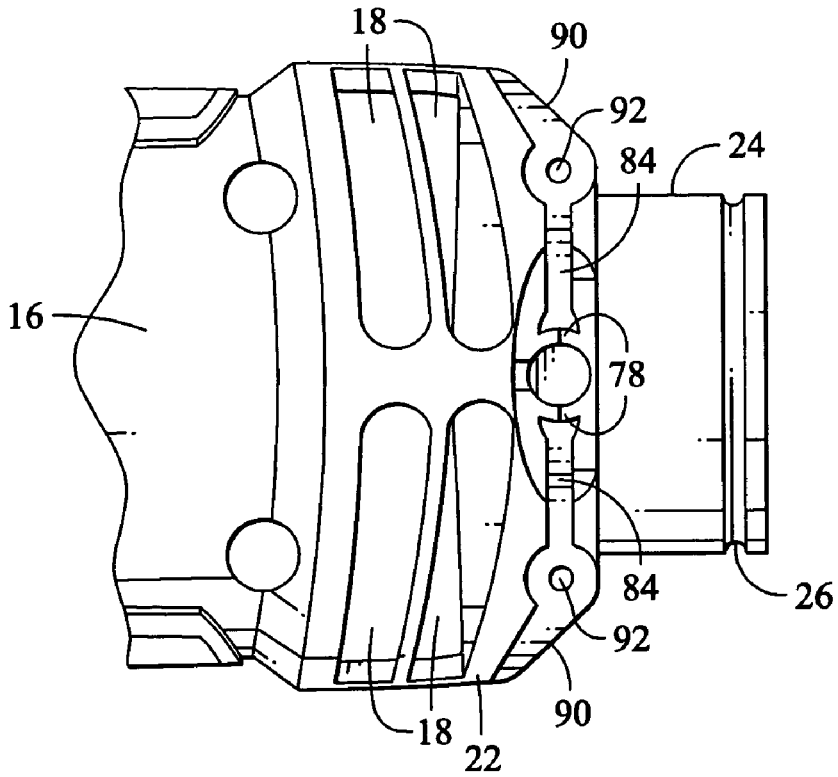
FIG. 6 is a top view of a plastic section that partially comprises the cylindrical plastic housing of the preferred embodiment.
Figure 7:
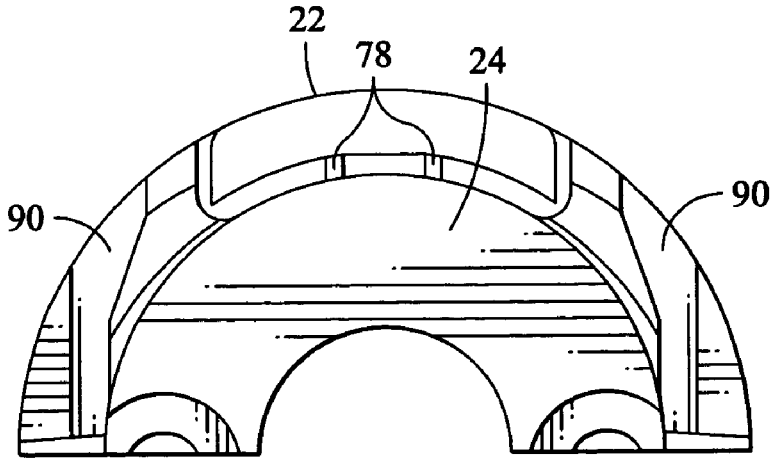
FIG. 7 is a front end view of the plastic section shown in FIG. 6.
Figure 8:
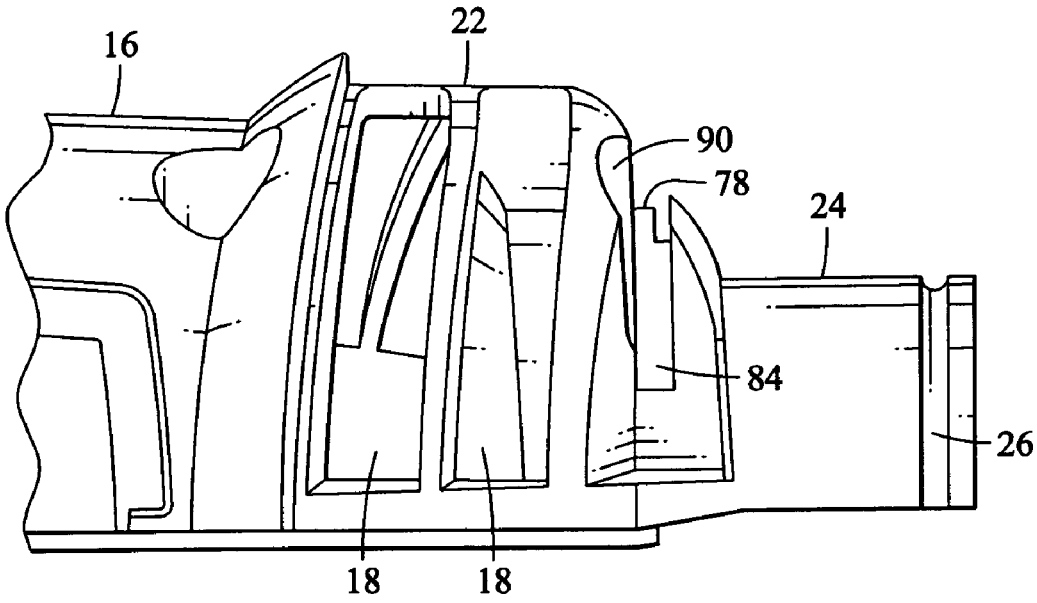
FIG. 8 is a side view of the plastic section shown in FIGS. 6 and 7.

The front portion has recesses 66 in which the screws 62 are inserted, with the recesses being formed by cylindrical walls 68 as shown in FIGS. 3 and 4. The cylindrical walls 68 are attached to the outer walls by a structural side rib 70. A pair of structural ribs 72 extend from the cylindrical wall portions 68 inwardly toward each other and are positioned adjacent cylindrical openings 74 that is sized to receive a cylindrical portion 78 in the plastic section 16. The ribs 72 each have a flared end portion 80 that has a curvature corresponding to the cylindrical wall portions 78 of the plastic piece (FIG. 6). The plastic section also has similarly configured recesses 84 located on opposite sides of the cylindrical wall 78 which are configured to receive the ribs 72 when the metal portion 60 is assembled, i.e., attached to the plastic section 16. The recesses 84 merge with cylindrical recesses 90 that are configured to receive the cylindrical portions 68 of the metal portion. The plastic portion has openings 92 through which the screws 62 may pass for engaging the complimentary section of the metal portion.

It should be understood that when the metal portion 60 is inserted over the plastic section 16, the cylindrical portion 78 that defines the channel 38 will be in contact with both the locking button 32 and with the surfaces 80 of the ribs 72 of the metal portion. With these components being in contact, if force is applied to the locking pin mechanism when it is engaged in the motor shaft 30, any stresses that are applied to the relatively thin narrow plastic cylindrical portions 78 will be transmitted to the strong metal ribs 72 that are present through a substantial portion of the length of the locking pin 50. That being the case, the likelihood of damage being done to the plastic section 16 is significantly reduced. The stress imposed upon the locking friction shaft lock locking mechanism 32 is in the direction that corresponds to a plane passing through the ribs 72 which is in the direction of greatest strength.

When the pin is inserted into the plastic portion 78, its orientation is accurately defined which means that is cannot be moved in any direction other than the lengthwise direction of the pin 50. That being the case, the flange 44 will prevent the button 32 from moving outwardly, which eliminates any need for an E-clip or a C-clip on the pin itself, as is common practice for commercially available spiral saws. Another advantage of the present design is that after the spring 52 is placed over the end of the pin 34, the button 32 can be inserted into the metal portion 60 so that when the metal portion is inserted, the cylindrical portion 42 of the locking button 32 will slide into the channel 38 defined by the cylindrical walls 78 of the plastic portion. The screws 62 can then be installed which completes the installation. It should be appreciated that while the locking button 32 has cylindrical portions 42 as well as a cylindrical pin 50, other cross-sectional configurations may be utilized, such as hexagonal, square or the like, with the walls defining the channel 38 and the plastic section being correspondingly configured.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A rotary power hand tool comprising:

an elongated generally cylindrical plastic housing having at least two mating plastic sections that fit together to form a unitary structure, said housing having at least a main portion, a front end portion, and a front opening in said housing;

a motor mounted at least partially within said main housing portion and having an elongated generally cylindrical motor output shaft extending from said main portion at least to said front end portion, said motor output shaft having at least one hole in the side surface thereof;

a locking member located in said front end portion and having an elongated pin portion slideable in a channel defined by at least one channel wall formed in said plastic front end portion, for engaging the output shaft hole to lock said motor shaft from rotation;

a front end metal portion having at least two mating sections configured to fit over said plastic front end portion, said metal portion having a pair of spaced apart structural ribs oriented generally transverse to the output shaft and extending inwardly toward the output shaft, said ribs terminating on opposite sides of said channel wall.

2. A rotary power hand tool as defined in claim 1 further comprising a cylindrically shaped nose portion located at the outer end portion of said front end portion for receiving accessory attachments to said hand tool.

3. A rotary power hand tool as defined in claim 1 wherein said locking member comprises a button portion having an elongated pin configured to enter said hole.

4. A rotary power hand tool as defined in claim 3 wherein said button portion has a wide configuration convenient for a user to depress, said button portion having an elongated cylindrical pin portion extending therefrom, said hole having a cylindrically shape sized to receive said pin portion.

5. A rotary power hand tool as defined in claim 4 wherein said button portion having a cylindrical extension with the pin portion extending therefrom, said channel being cylindrically shaped and sized to receive said cylindrical extension therein.

6. A rotary power hand tool as defined in claim 4 wherein said metal portion has a narrow recess therein adjacent said button portion, said button portion having a flange that extends into said recess and limits outward movement of said button portion.

7. A rotary power hand tool as defined in claim 1 wherein said channel has a reduced diameter adjacent the output shaft, said tool further comprising a spring located in said channel for biasing said locking member away from the output shaft.

8. A rotary power hand tool as defined in claim 1 wherein said structural ribs are at least in near contact with said channel wall.

9. A rotary power hand tool comprising:

an elongated generally cylindrical plastic housing having at least two mating plastic sections that fit together to form a unitary structure, said housing having at least a main portion, a front end portion, and a front opening in said housing;

a motor mounted at least partially within said main housing portion and having an elongated generally cylindrical motor output shaft extending from said main portion at least to said front end portion, said motor output shaft having at least one hole in the side surface thereof;

a locking member located in said front end portion and having an elongated pin portion slideable in a channel for engaging the output shaft hole to lock said motor shaft from rotation;

a front end metal portion having at least two mating sections configured to fit over said plastic front end portion, said metal portion having a pair of spaced structural ribs oriented in a plane generally transverse to the output shaft and extending inwardly toward the output shaft, said ribs terminating on opposite sides of said channel in position to absorb stress applied to said locking member when rotational torque is applied to the output shaft with said elongated pin portion engaged in the output shaft hole.

10. A rotary power hand tool as defined in claim 9 further comprising a cylindrically shaped nose portion located at the outer end portion of said front end portion for mounting accessory attachments to said hand tool.

11. A rotary power hand tool as defined in claim 9 wherein said locking member comprises a button portion having an elongated pin configured to enter said hole.

12. A rotary power hand tool as defined in claim 11 wherein said button portion has a wide configuration convenient for a user to depress, said button portion having an elongated cylindrical pin portion extending therefrom, said hole having a cylindrically shape sized to receive said pin portion.

13. A rotary power hand tool as defined in claim 12 wherein said button portion having a cylindrical extension with the pin portion extending therefrom, said channel being cylindrically shaped and sized to receive said cylindrical extension therein.

14. A rotary power hand tool as defined in claim 12 wherein said metal portion has a recess therein adjacent said button portion, said button portion having a flange that extends into said recess and limits outward movement of said button portion.

15. A rotary power hand tool as defined in claim 9 wherein said channel has a reduced diameter adjacent the output shaft, said tool further comprising a spring located in said channel for biasing said locking member away from the output shaft.

* * * * *